US006899633B1

(12) United States Patent
Kienzle

(10) Patent No.: US 6,899,633 B1
(45) Date of Patent: May 31, 2005

(54) APPARATUS FOR GENERATING A COMPLEX ACOUSTIC PROFILE REPRESENTING THE ACCELERATION PATTERN OF AN OBJECT MOVING THROUGH A PATH OF TRAVEL

(76) Inventor: John A. Kienzle, 1802 N. Broadway, Shawnee, OK (US) 74804-3720

( * ) Notice: Subject to any disclaimer, the term of this patent is extended or adjusted under 35 U.S.C. 154(b) by 83 days.

(21) Appl. No.: 10/385,974

(22) Filed: Mar. 11, 2003

Related U.S. Application Data

(60) Provisional application No. 60/363,398, filed on Mar. 11, 2002.

(51) Int. Cl.[7] ..... A63B 69/36
(52) U.S. Cl. ..... 473/224; 473/234
(58) Field of Search ..... 473/224, 223, 473/219, 228, 234; 446/216

(56) References Cited

U.S. PATENT DOCUMENTS

| | | | | | |
|---|---|---|---|---|---|
| 805,132 | A | | 11/1905 | Gubbins | |
| 1,549,350 | A | | 8/1925 | Deike | |
| 3,776,556 | A | * | 12/1973 | McLaughlin | 473/234 |
| 4,027,886 | A | * | 6/1977 | Katsube | 473/234 |
| 4,094,504 | A | | 6/1978 | Barasch | |
| 4,222,562 | A | * | 9/1980 | Gardner | 273/129 K |
| 4,283,057 | A | | 8/1981 | Ragan | |
| 4,953,868 | A | | 9/1990 | Thompson et al. | |
| 4,969,921 | A | * | 11/1990 | Silvera | 473/234 |
| 5,273,278 | A | | 12/1993 | Becker | |
| 5,984,799 | A | * | 11/1999 | Romano | 473/234 |
| 6,001,023 | A | * | 12/1999 | Sanchez et al. | 473/217 |
| 6,027,414 | A | * | 2/2000 | Koebler | 473/228 |
| 6,503,149 | B2 | * | 1/2003 | Jelinek | 473/224 |

FOREIGN PATENT DOCUMENTS

| | | | | | |
|---|---|---|---|---|---|
| GB | 2200234 | A | * | 7/1988 | G10K 5/00 |
| JP | 09234261 | A | * | 9/1997 | A63B 69/36 |

* cited by examiner

*Primary Examiner*—Gregory Vidovich
*Assistant Examiner*—Nini F. Legesse
(74) *Attorney, Agent, or Firm*—Mary M. Lee

(57) ABSTRACT

An apparatus for generating an acoustic profile representing the acceleration pattern of an object moving through a path of travel. The apparatus comprises a flute assembly attachable to a golf club. Preferably, the flute assembly comprises three cross flutes with three different fundamental frequencies aligned axially on the shaft of the club. The swinging motion of the club creates a complex, multi-tone acoustic profile indicative of the acceleration pattern of the club throughout the down swing. The golfer can then compare his profile to the swing of a known, great golfer, and then practice until he duplicates the sound of the model swing. While the apparatus is especially useful for golfers, the apparatus may be adapted to a wide variety of other sports implements, such as baseball bats, hockey sticks and tennis rackets, for example. An assembly comprising the apparatus in combination with the sports implement is also provided.

36 Claims, 3 Drawing Sheets

APPARATUS FOR GENERATING A COMPLEX ACOUSTIC PROFILE REPRESENTING THE ACCELERATION PATTERN OF AN OBJECT MOVING THROUGH A PATH OF TRAVEL

This application claims the benefit of the filing date of provisional application Ser. No. 60/363,398, entitled "Acceleration Detectors Using Different Primary Resonace [sic] Tone [sic]," filed Mar. 11, 2002, the contents of which are incorporated herein by reference.

FIELD OF THE INVENTION

The present invention generally relates to acoustic accelerometers and, more particularly but without limitation, to devices which emit audible signals indicative of acceleration patterns of moving objects.

BACKGROUND OF THE INVENTION

Avid golfers, professional and amateur alike, endlessly seek to improve their game and, especially the speed and form of their swing. Of particular importance is the form and acceleration of the downswing through the "hitting zone."

Often a golfer seeking improvement may wish to compare his swing to that of a great golfer. However, visually monitoring one's own swing is problematic. It is difficult, of course, objectively and accurately to assess one's own swing during the actual act of swinging. Even when reproduced visually, on videotape for example, it is difficult to assess the speed and form of a swing because of the high speed at which the club moves.

The present invention provides a way for a golfer to generate an acoustic profile of his swing, and to compare it with the acoustic profile of a model golfer. This permits the golfer to listen to the sound made by a great golfer and then practice until he achieves the same sound pattern with regularity. The present invention provides an acoustic profile comprising two or more different sequential tones that reach maximum intensities from different primary tones or from the harmonics of those different primary tones. This complex profile provides a more accurate picture of a larger segment of the swing, not just the speed at the moment of ball strike. The golfer can easily hear the sound of his swing even while he is swinging. In addition, it is easier to compare the sound profiles of two selected swings than it is to compare the same swings visually.

To this end, the present invention provides an apparatus for generating an acoustic profile indicative of the acceleration of the golfer's club during the critical downswing and hitting zone phases of his swing. It will be appreciated that, although the present invention is described as applied to a swinging golf club, the apparatus of this invention will have many other applications in other sports and outside the field of athletics. For example, it is useful to evaluate the swing profile of other types of sports implements, such as baseball and softball bats, hockey and polo sticks, casting rods, and tennis, squash and racquetball rackets.

SUMMARY OF THE INVENTION

The present invention is directed to an apparatus for producing an acoustic profile representative of the acceleration pattern of an object moving in at least a first direction through a path of travel. The apparatus comprises a flute assembly attachable to the object. The flute assembly comprises at least two flutes having different fundamental frequencies. Also included in the apparatus is a connector assembly adapted to attach the flute assembly to the object.

Still further, the present invention comprises an assembly including an object movable through a path of travel, and an apparatus associated with the object for producing an acoustic profile representative of the acceleration pattern of the object as it moves in at least a first direction through the path of travel. The apparatus comprises a flute assembly comprising at least two flutes having different fundamental frequencies.

DETAILED DESCRIPTION OF THE PREFERRED EMBODIMENT(S)

Figure 1:
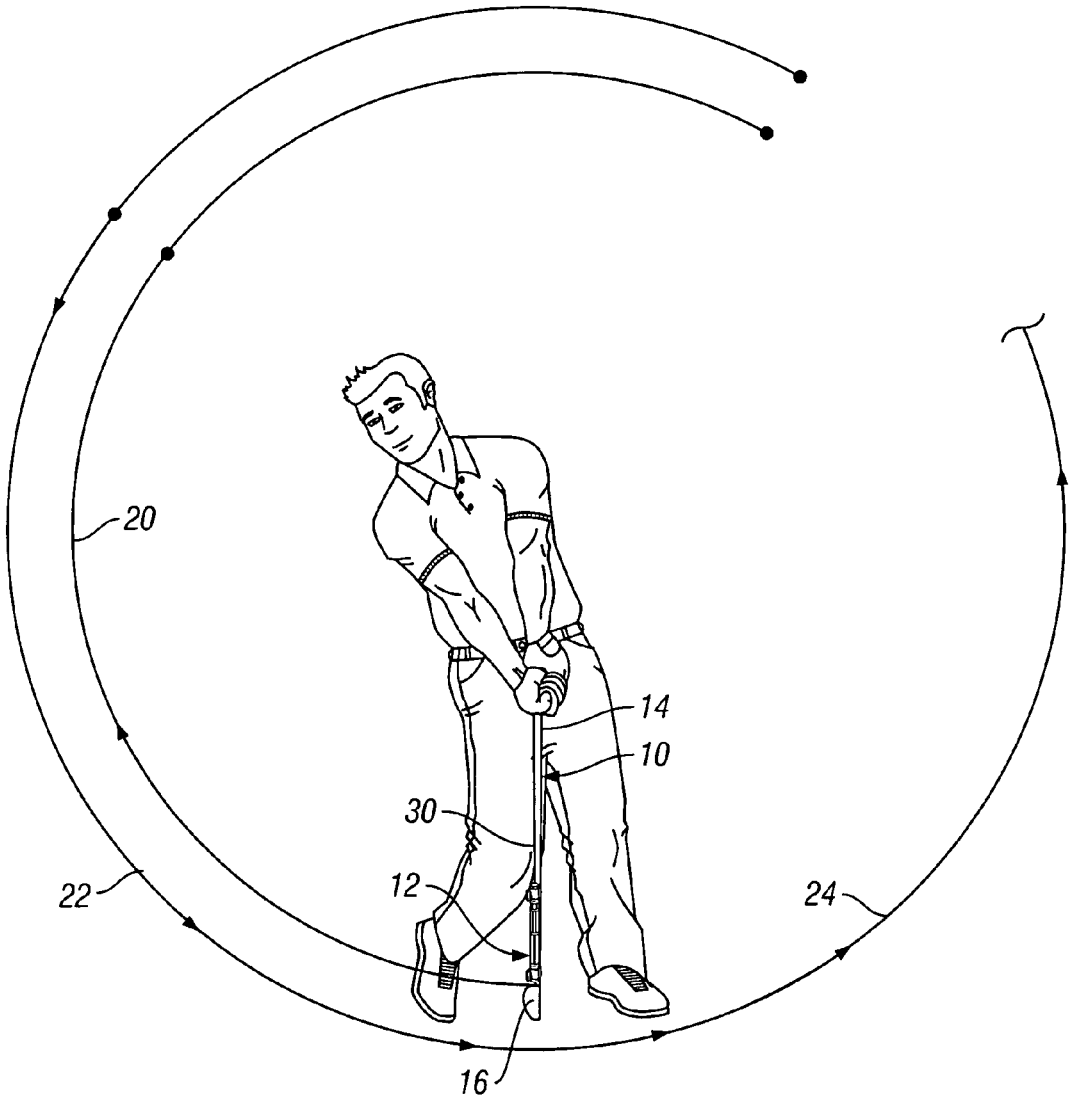
FIG. 1 is a schematic drawing of a golfer swinging a golf club using the apparatus of the present invention. The drawing is lined to indicate the approximate path of travel of the club as it is swung through the backswing and downswing. The follow-through is not fully shown to simplify the illustration.

Turning now to the drawings in general and to FIG. 1 in particular, there is shown therein an assembly comprising apparatus constructed in accordance with the present invention. The assembly is designated generally by the reference numeral 10 and the apparatus by the reference numeral 12.

The apparatus 12 is adapted for producing an acoustic profile representative of the acceleration pattern of an object moving in at least a first direction through a path of travel. As illustrated in FIG. 1, the object may be a golf club 14. Alternately, the object may be another type of sports implement, or another object which is swung or thrown, where the speed and/or position of the moving object are of interest. Preferably, when the object is a sports implement, it is a sports implement with a shaft. Such sports implements include golf clubs, hockey sticks, baseball and softball bats, tennis rackets, racquetball rackets, squash rackets, casting rods, polo sticks, and the like. Other sports implements that are thrown and not swung, and to which the present invention, may be adapted, include javelins, spears, disks, and the like.

The path of travel may be curved or arced, as in the case of the golf swing depicted in FIG. 1. The typical golf swing may be considered having several phases including the initial back swing, indicated by the line at 20, commencing at the resting position in front of the golfer and continuing in an arc to a point well beyond the golfer's head. The next phase is the downswing, indicated by the line at 22, where the velocity of the club 14 greatly and rapidly accelerates until the head 16 of the club hits the ball (not shown). Next is the follow through, indicated only partially by the line at 24.

Although in the preferred use of the assembly of this invention, the path of travel is represented by a curved line, or arc, it need not be this shape. Rather, a single continuous path of travel may be straight, indicated by a straight line, or an irregular curve or some other configuration.

The apparatus 12 is designed to produce an acoustic profile as the object travels along the path in at least a first direction. The object, such as the golf club 14, preferably has an elongate shaft 30. This provides an ideal location for attachment or incorporation of the apparatus 12, as will become apparent.

Figure 2:
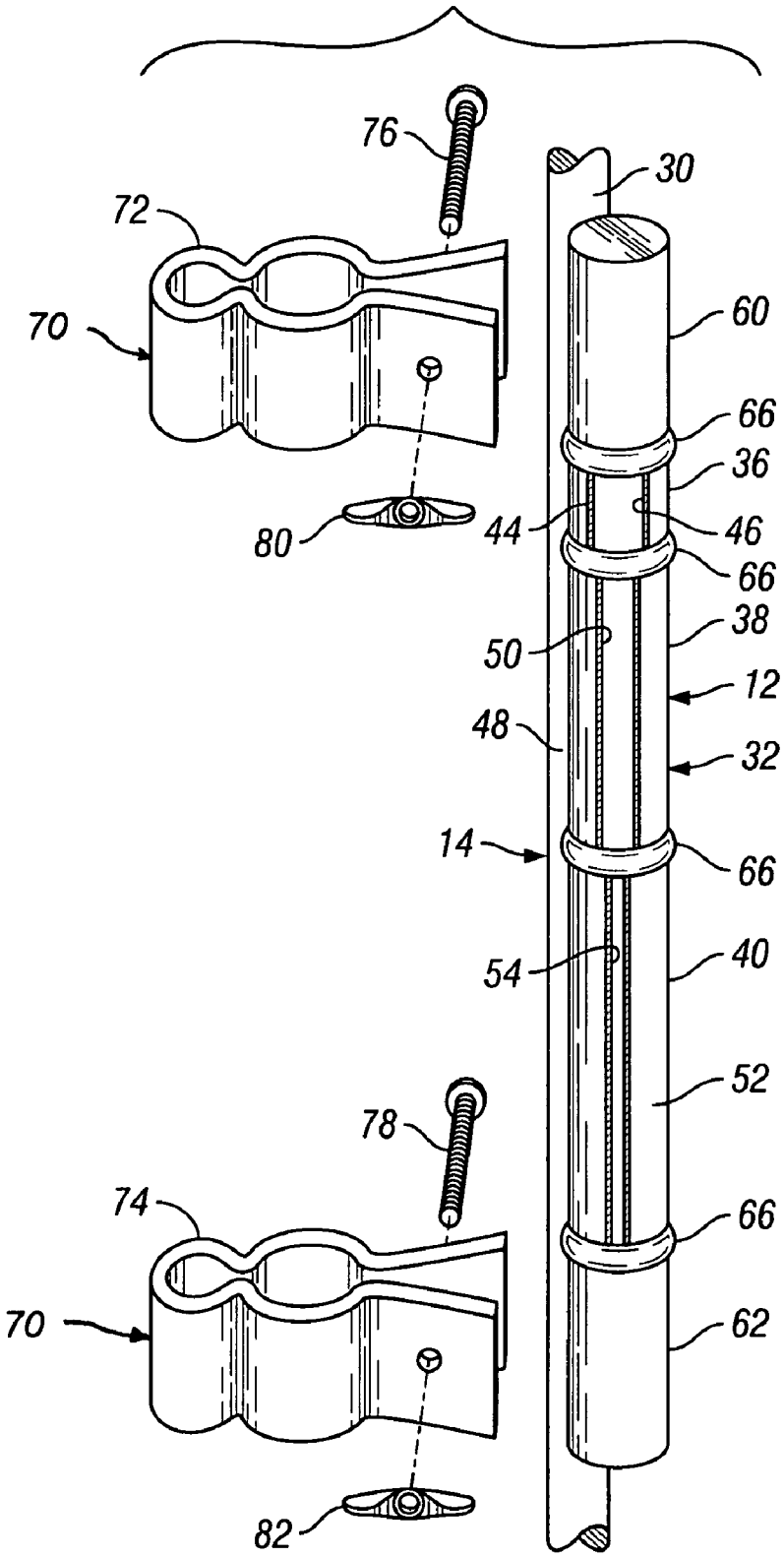
FIG. 2 is an enlarged perspective view of the apparatus on the shaft (fragmented) of the golf club.

Turning now to FIG. 2, the apparatus 12 will be described. As shown and described in this preferred embodiment, the apparatus 12 is shown as separate from and connectable to the shaft 30 of the golf club 14. This allows the golfer to use his own clubs to practice with the apparatus. However, it is to be understood, that in some applications it may be advantageous to incorporate the apparatus into the object. For example, the apparatus could be installed inside the shaft of a golf club, designed solely for training purposes.

Referring still to FIG. 2, the flute assembly 32 comprises at least two flutes. As used herein, "flute" means a wind-operated resonator, that is, any kind of hollow resonator that is wind driven. This may include devices commonly referred to as flutes, whistles, recorders, and includes pipe and non-pipe resonators. "Flute" includes, for this invention, reed instruments and non-reed instruments. As used herein, "flute" includes a transverse or cross flute as well as an end-blown flute. In addition, "flute" includes a conventional open-ended flute, as well as closed-ended tube. Most preferably, the flutes used in this invention are Aeolian flutes. An Aeolian flute is a closed chamber with one sound opening only. More preferably, the flutes in this invention are elongate tubes with the sound hole being a side opening, forming a closed cylinder, cross flute. Thus, these flutes are similar to a Helmholtz resonator, though they are not spherical.

With continuing reference to FIG. 2, the preferred flute assembly comprises three flutes. At least two of the flutes have different fundamental frequencies. Where there are three flutes, as in the disclosed embodiment, it is preferred but not essential that each of the flutes has a different fundamental frequency. Accordingly, the flute assembly 32 comprises a first flute 36, a second flute 38 and a third flute 40. The first flute 36 is tuned to a first fundamental frequency. The second flute 38 is tuned to a second fundamental frequency, and the third flute 40 is tuned to a third fundamental frequency.

Now it will be appreciated that, where the flutes comprise single-hole, closed-end tubes, the flutes easily may be "tuned" to different frequencies simply by providing each flute with a different length. Thus, the first flute 36 comprises a tubular body 44 with a longitudinal opening 46; the second flute 38 comprises a tubular body 48 with a longitudinal opening 50; and the third flute 40 comprises a tubular body 52 with a longitudinal opening 54.

The fundamental frequency of each of the flutes can be determined by the following formula:

$$f=(c/(2*Pi))*(a/(v*(d+a\hat{}.5)))\hat{}.5$$

where "f" is the frequency, "c" is the air velocity of sound, "a" is the sound hole area, "d" is the thickness of the sound hole, and "v" is the volume of the resonant chamber.

Preferably, the first, second and third flutes 36, 38 and 40 are aligned axially relative to the shaft 30 of the golf club 14, and more preferably aligned axially along a line parallel to the shaft 30. That is, in this embodiment, the flutes are positioned end-to-end in the apparatus 12. In this way, as the club is swung, air will pass transversely across the openings 46, 50 and 54, and cause the flutes to resonate.

In the preferred embodiment, each of the flutes 36, 28 and 40 has a fixed length, so that its fundamental frequency is non-adjustable. It is also preferable that each of the flutes has the same diameter but a different chamber length and a different area for each sound hole, chosen to tune each fundamental resonant frequency to create a complimentary set for the overall pattern of sound.

Referring still to FIG. 2, the flute assembly 32 preferably comprises first and second end members 60 and 62, between which the end-to-end flutes 36, 38 and 40 are supported. The end members 60 and 62 preferably are also cylindrical having a diameter similar to that of the three flutes. The end members provide a simple means for attaching the flute assembly to the shaft 30 of the golf club 14, in the manner described hereafter.

The flutes 36, 38 and 40 can be made conveniently from some suitable tubular material cut to different lengths. Using resilient disks or diaphragms, designated collectively by the reference numeral 66, these tubular elements can be glued or otherwise connected end to end between the end members 60 and 62, so that the open ends of the flute members are sealed. Many other forms of construction and manufacture will be apparent.

As illustrated in FIG. 2, the apparatus 12 comprises a connector assembly 70 adapted to attach the flute assembly to the shaft 30 of the golf club 14. In the preferred embodiment, the connector assembly 70 comprises one or more, and preferably two, clamps 72 and 74, or other connectors. The clamps 72 and 74 may be formed of any suitable semi-rigid, slightly resilient material, which permits the clamp to snap around the shaft 30 and the end members 60 and 62. Bolts 76 and 78 and wing nuts 80 and 82 are provided for tightening each clamp in place. Alternately, the clamps or other connectors can be formed integrally with the flute assembly. It will be noted that using this type of connector assembly allows the flute assembly to be rotated relative to the axis of the shaft 30. Many other types of connectors could be substituted for the clamps, such as clips, hook and loop fasteners, belts straps, elastic bands, adhesives, and tapes.

Figure 3:
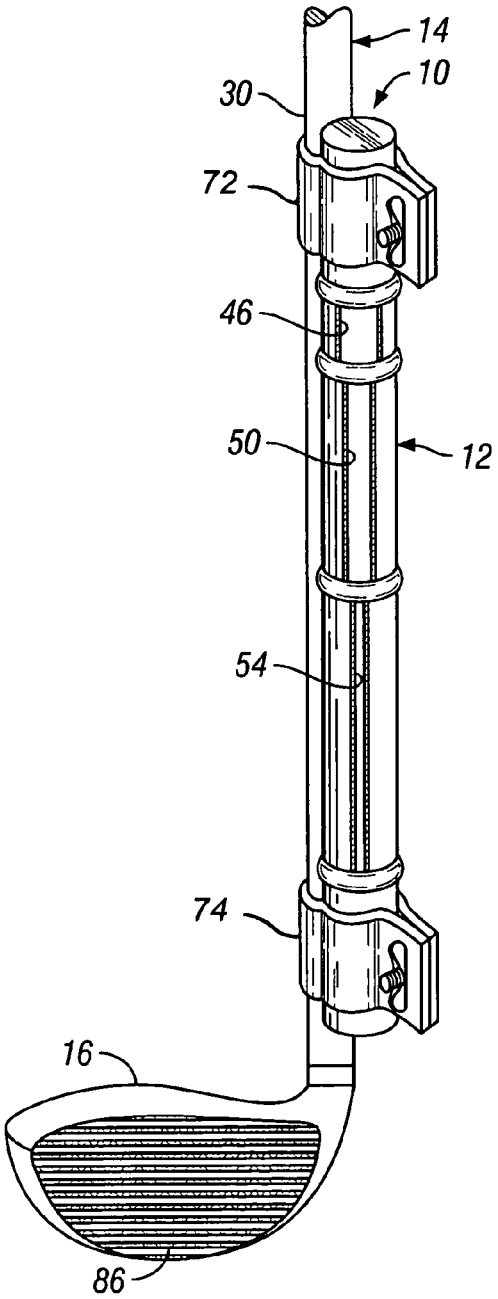
FIG. 3 is a perspective view of the apparatus oriented to emit sound during the forward swing, with the air holes of the flutes aligned toward the face of the head of the club.

With reference now to FIG. 3, the positioning of the apparatus 10 on the shaft 30 of the golf club 14 will be discussed. As described, in most instances, the golfer using the apparatus 12 will position it to generate an acoustic profile of his downswing. For this purpose, the apparatus 12 will be positioned generally as depicted in FIG. 3. In this mode of operation, the sound holes 46, 50 and 54 are oriented in a more or less forward direction relative to the face 86 of the club head 16. Rotating the apparatus 12 about 45 degrees from the plane of the club face 86 is usually ideal.

Figure 4:
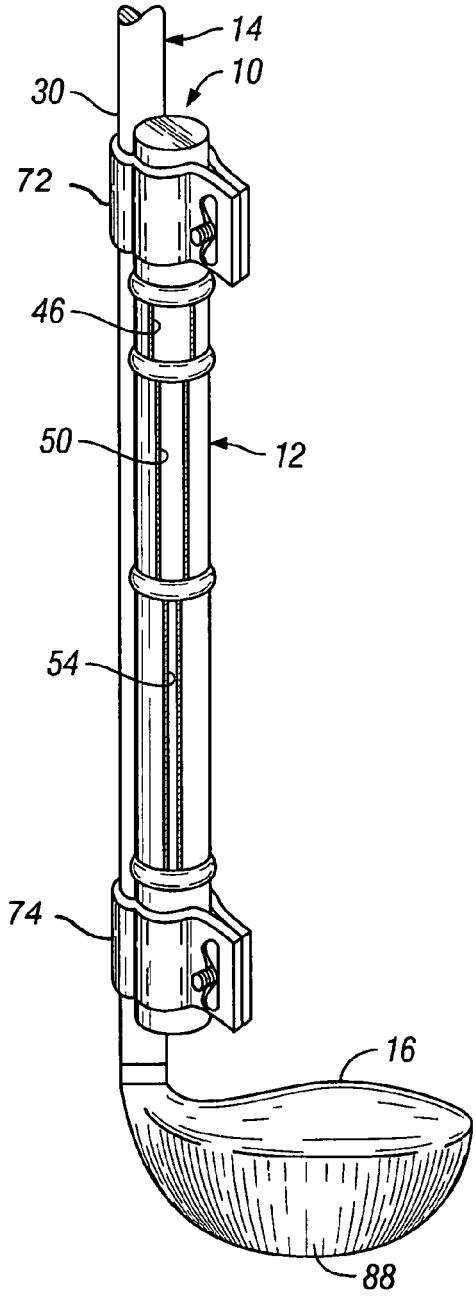
FIG. 4 is a perspective view of the apparatus oriented to emit sound during the back swing, with the air holes of the flutes aligned toward the back of the head of the club.

However, this invention contemplates an apparatus which can be adapted to generate a signal in a second direction. For example, a golfer may want to analyze his initial back swing 20 as well as his downswing. In this case, the clamps (not shown in FIG. 4) can be loosened and the flute assembly 32 rotated around the shaft 30 so that the sound holes 46, 50 and 54 are aligned more towards the back 88 of the club head 16. In this manner, the apparatus can be used in various sports where the sports implement is swung bi-directionally, such as tennis or polo. Although not depicted in the drawings, the apparatus 12 could comprise more than one set of flutes, having one set for sounding in a first direction and a second set for sounding in the reverse direction.

The three flutes 36, 38, and 40 may be fixed permanently in the arrangement depicted in FIG. 2. Alternately, the flutes may be mounted for individual rotational movement in the apparatus. In this way, the clocking position of each flute can be adjusted independently of the others.

Now it will be apparent that, when the apparatus 12 is attached to the shaft of a golf club, swinging the club at sufficient speeds will cause the flutes to resonate. Depending on the speed at which the club is swung, the position of the club, the orientation or clocking position of the flutes relative to the shaft, and the size and configuration of the flutes and their sound holes, the sounds emitted by the apparatus may vary. The apparatus 12 is designed so, during a good, fast swing, each of the flutes 36, 38 and 40 can achieve its maximum tone intensity at a different velocity. Preferably, each flute can achieve maximum intensity of its fundamental frequency or harmonics of its fundamental frequency at a different point in the swing, allowing the assembly of flutes to produce audibly different tones in sequence, if the swing is fast enough to satisfy the velocity of each flute.

The user will hear distinguishable, abruptly occurring tones of different frequencies in closer and closer sequence in time as the velocity of the club increases. While the apparatus 12 is in operation, the flutes may produce harmonic frequencies, but each flute 36, 38 and 40 makes a primary tone having a different fundamental frequency. This creates a more distinctive and complex acoustic profile of a swing pattern.

This acoustic profile, therefore, represents the acceleration pattern of the golf club as it is swung. As used herein, "acceleration" is used in its broad sense to denote a change in velocity, that is, an increase or a decrease in velocity. Since the speed of the golf club, or other sports implement, varies as it travels through the swing, this change in speed is reflected in the variable sounds generated by the flutes in the apparatus.

In the embodiment described, a low pitched tone is heard as the club 14 is slowly brought down in the down swing 22 (FIG. 1) of the stroke. As the club accelerates, other distinct and different tones are heard. A very slow down swing only has two tones. The third tone is heard with higher velocities. With a high velocity swing, the time intervals between the second and third tones decrease. The intervals separating the distinct sounds vary depending on whether the golfer has a high club head velocity or a slow club head velocity. A swing with a very fast club head velocity will produce a characteristic sound pattern that is very easily remembered. Ideally, an adequate golf swing will have a sound similar to a Bobwhite bird call, while an even faster swing will have the last tones heard as being more intense and coming closer together.

The swings of expert golfers can be recorded using the apparatus of this invention. Any other golfer can listen to this "model" sound profile and, using the apparatus of this invention, practice swinging until he is able to duplicate consistently the same sound profile as the "model" swing. In this way, the golfer can verify that he is swinging correctly and consistently, and achieve improvement in his velocity, timing and rhythm.

It will now be understood that "acoustic profile" means an audible pattern comprising a plurality of different tones including different fundamental tones or their harmonics or both, sequentially heard as the object moves through a path of travel at a sufficient speed to generate resonance in the flutes. Acoustic profile may also include harmonics of the fundamental tones which enrich the overall profile.

In the embodiment described herein, the three flutes 36, 38 and 40 have a fixed length and therefore are non-adjustable. Thus, two or more separate simultaneously existing flute chambers must be used to obtain different fundamental frequencies. However, it will be understood, that the invention contemplates the use of a single flute with a variable length providing multiple fundamental frequencies with each different length. For example, a single flute chamber could be provided with a sliding partition or moving ball, where the movement is activated by centrifugal force exerted on the object as it accelerates. This structure in effect provides multiple flutes depending on the position of the ball or partition.

It will be seen that in the preferred embodiments, the sound holes 46, 50 and 53, though different lengths and widths, are all aligned longitudinally. Though this is a preferred arrangement, the sound holes can be "clocked" differently. That is, one or more of the flutes 36, 38 and 40 can be rotated about the axis of the golf club shaft 30 so that the sound holes are not aligned. This may be done to vary the sounds generated by the apparatus 12, depending on the characteristics of the object's motion as it is moved through the path of travel. For example, this can aid in detecting undesirable rotation of the golf club shaft during the swing.

In the embodiments shown and described herein, all the flutes used in the flute assembly have been of the same type. In some applications of this invention, it may be advantageous to combine flute types, such as using a reed flute with a non-reed flute.

Other changes can be made in the combination and arrangement of the various parts and steps described herein without departing from the spirit and scope of the invention.

What is claimed is:

1. An apparatus for producing an acoustic profile representative of the acceleration pattern of an object moving in at least a first direction through a path of travel, the apparatus comprising:

a flute assembly attachable to the object, the flute assembly comprising at least two flutes having different fundamental frequencies, wherein the two flutes are oriented in the flute assembly so that, when the flute assembly is attached to the object and the object is accelerated in the first direction through the path of travel at speeds sufficient to generate resonance in each of the two flutes, the flute assembly produces an acoustic profile including two sequential tones;

wherein the object comprises an elongate shaft having a longitudinal axis, wherein the at least two flutes comprises first and second flutes, wherein each of the flutes has a longitudinal axis, and wherein the first and second flutes are longitudinally positionable along the shaft of the object so that the longitudinal axis of each flute is parallel to the longitudinal axis of the shaft; and a connector assembly adapted to attach the flute assembly to the object.

2. The apparatus of claim 1 wherein the at least two flutes include a first flute and a second flute, the first flute tuned to a first fundamental frequency and the second flute tuned to a second fundamental frequency, and wherein the fundamental frequencies of the first and second flutes are non-adjustable.

3. The apparatus of claim 2 wherein the first and second flutes are aligned axially along a line parallel to the shaft of the object.

4. The apparatus of claim 3 wherein each of the first and second flutes comprises a single-hole chamber.

5. The apparatus of claim 4 wherein the object is a golf club, and wherein the apparatus is attachable to the shaft of the golf club.

6. The apparatus of claim 2 wherein the flute assembly further comprises a third non-adjustable flute tuned to a third fundamental frequency.

7. The apparatus of claim 1 wherein the at least two flutes include a first, second and third flute, the first flute tuned to a first fundamental frequency, the second flute tuned to a second fundamental frequency, and the third flute tuned to a third fundamental frequency, wherein the object comprises an elongate shaft, and wherein the first, second and third flutes are aligned axially relative to the shaft of the object, and wherein each of the first, second and third flutes is a single-hole chamber.

8. The apparatus of claim 7 wherein each of the first, second and third flutes is a cross flute.

9. The apparatus of claim 8 wherein each of the first, second and third flutes is a closed cylinder with a single sound hole.

10. The apparatus of claim 9 wherein each of the first, second and third flutes has the same diameter and a different length.

11. The apparatus of claim 1 wherein the first and second flutes are cross flutes.

12. The apparatus of claim 1 wherein each of the first and second flutes is a single-hole chamber.

13. The apparatus of claim 1 wherein the object is a golf club with a shaft, wherein the apparatus is attachable to the shaft of the golf club.

14. The apparatus of claim 1 wherein the connector assembly is adapted to removably connect the flute assembly to the object.

15. The apparatus of claim 14 wherein the connector assembly comprises a pair of clamps.

16. The apparatus of claim 1 wherein the at least two flutes in the flute assembly are comprised of two separate flute chambers existing simultaneously.

17. The apparatus of claim 16 wherein the sound holes in the at least two flutes are aligned axially.

18. The apparatus of claim 1 wherein the connector assembly is integrally formed with the flute assembly.

19. An assembly comprising:

an object movable in a first direction through a path of travel, the object having an elongate shaft; and an apparatus attached to the object, the apparatus comprising at least two flutes having different fundamental frequencies, wherein the two flutes are oriented relative to the object so that, when the object is accelerated in the first direction through the path of travel at speeds sufficient to generate resonance in each of the two flutes, the flutes produce an acoustic profile including two sequential tones, the acoustic profile being representative of the acceleration pattern of the object, wherein the at least two flutes comprises first and second flutes, wherein each of the flutes has a longitudinal axis, and wherein the first and second flutes are longitudinally positionable along the shaft of the object so that the longitudinal axis of each flute is parallel to the longitudinal axis of the shaft.

20. The assembly of claim 19 wherein the at least two flutes include a first flute and a second flute, the first flute tuned to a first fundamental frequency and the second flute tuned to a second fundamental frequency, and wherein the fundamental frequencies of the first and second flutes are non-adjustable.

21. The assembly of claim 20 wherein the first and second flutes are aligned axially along a line parallel to the shaft of the object.

22. The assembly of claim 21 wherein each of the first and second flutes is a single-hole chamber.

23. The assembly of claim 22 wherein the object is a golf club, and wherein the apparatus is attachable to the shaft of the golf club.

24. The assembly of claim 20 wherein the flute assembly further comprises a third non-adjustable flute tuned to a third fundamental frequency.

25. The assembly of claim 19 wherein the at least two flutes include a first, second and third flute, the first flute tuned to a first fundamental frequency, the second flute tuned to a second fundamental frequency, and the third flute tuned to a third fundamental frequency, wherein the object comprises an elongate shaft, and wherein the first, second and third flutes are aligned axially relative to the shaft of the object, and wherein each of the first, second and third flutes is a single-hole chamber.

26. The assembly of claim 25 wherein each of the first, second and third flutes is a cross flute.

27. The assembly of claim 26 wherein each of the first, second and third flutes is a closed cylinder with a single sound hole.

28. The assembly of claim 27 wherein each of the first, second and third flutes has the same diameter and a different length.

29. The assembly of claim 19 wherein the first and second flutes are cross flutes.

30. The assembly of claim 19 wherein each of the two flutes is a single-hole chamber.

31. The assembly of claim 19 wherein the object is a golf club, wherein the apparatus is separate from and attachable to the shaft of the golf club.

32. The assembly of claim 19 wherein the apparatus comprises a connector assembly adapted to connect the flute assembly removably to the shaft of the golf club.

33. The assembly of claim 32 wherein the connector assembly comprises a pair of clamps.

34. The assembly of claim 33 wherein the sound holes in the at least two flutes are aligned axially.

35. The assembly of claim 32 wherein the connector assembly is integrally formed with the flute assembly.

36. The assembly of claim 19 wherein the at least two flutes in the flute assembly are comprised of two separate flute chambers existing simultaneously.

* * * * *